United States Patent [19]

Gibas

[11] Patent Number: 4,468,647

[45] Date of Patent: Aug. 28, 1984

[54] ACTIVATING MAGNET

[75] Inventor: Christoph Gibas, Neunkirchener, Fed. Rep. of Germany

[73] Assignee: bso Steuerungstechnik GmbH, Fed. Rep. of Germany

[21] Appl. No.: 544,645

[22] Filed: Oct. 24, 1983

[30] Foreign Application Priority Data

Oct. 23, 1982 [DE] Fed. Rep. of Germany ..... 3239345

[51] Int. Cl.[3] ..... H01F 7/08

[52] U.S. Cl. ..... 335/262; 335/260

[58] Field of Search ..... 335/251, 255, 257, 260, 335/262

[56] References Cited

U.S. PATENT DOCUMENTS 4,067,541 1/1978 Hunter ..... 335/260

FOREIGN PATENT DOCUMENTS 2251215 4/1973 Fed. Rep. of Germany ..... 335/262

2236586 2/1974 Fed. Rep. of Germany ..... 335/262

*Primary Examiner*—George Harris

*Attorney, Agent, or Firm*—Wigman & Cohen

[57] ABSTRACT

An activating magnet having two coaxial pole tube portions which are spaced from each other, have the same inner and outer diameters and are connected with each other by means of a connecting ring of solder. In order to create an activating magnet in which the pole tube portions need only be machined on the outside or inside diameter, a spacing ring of a non-magnetizable material is arranged between the two pole tube portions. The spacing ring is thinner than the two pole tube portions, whereby the connecting ring has the same outside diameter and the spacing ring has the same inside diameter as the pole tube portions, or vice versa. A guide tube of a non-magnetizable material may be provided within the pole tube portions and the spacing ring.

2 Claims, 2 Drawing Figures

ACTIVATING MAGNET

BACKGROUND OF THE INVENTION

The invention relates to an activating magnet. More particularly, the invention relates to an activating magnet having a coaxial pole tube portions connected by a solder ring.

In a known activating magnet of the above type, both the inner and the outside diameter must be machined to achieve a uniform diameter, because the connecting ring, which is manufactured by a soldering process, projects both on the inside and on the outside. The connecting ring may have cavities if the soldering process used in its manufacture was performed deficiently. Any such inwardly open cavities can negatively influence the movement of the armature.

OBJECTS AND SUMMARY OF THE INVENTION

The object of the present invention is to provide an activating magnet in which the pole tube portion need only be machined on the outside or inside diameter. A further object of the present invention is to provide an activating device comprising two coaxial pole tube portions which are spaced from each other and have the same inner and outer diameters, said pole tube portions are connected with each other by a connecting ring containing solder, a spacing ring made of a non-magnetizable material and surrounded by the connecting ring is arranged between the two pole tube portions, said spacing ring is thinner than the two pole tube portions, whereby the connecting ring has the same outer diameter and the spacing ring has the same inside diameter as the pole tube portions, or vice versa.

In this manner, the spacing ring, which has the same inside or the same outside diameter as the pole tube portions, then no longer needs to be machined. Only the connecting ring, which projects beyond the inside or the outside diameter of the pole tube portons and is made of solder, requires machining. Preferably, the inside diameter of the spacing ring and that of the pole tube portions are the same, so that the connecting ring can be installed in a simple manner from the outside. Despite the use of an additional element, the activating magnet formed according to the invention is more economical to manufacture than the known activating magnet.

By means of a guide tube provided on the inner periphery of the pole tube portions, a defect-free guiding is achieved for the armature, for the pole tube portions which are connected with each other and for the spacing ring. This spacing ring serves as a heat protection shield for the relatively thin guide tube. This permits a precise manufacture of the activating magnet, because it centers the tubular elements surrounding the guide tube. An activating magnet formed with the guide tube therein is more economical to manufacture than the known magnets, despite having two additional parts.

BRIEF DESCRIPTION OF THE DRAWINGS

Additional advantages will be apparent from the description and the drawing. In the drawings, two activating magnets are schematically illustrated as exemplary embodiments of the present invention, wherein.

DETAILED DESCRIPTION OF PREFERRED EMBODIMENTS

Figure 1:
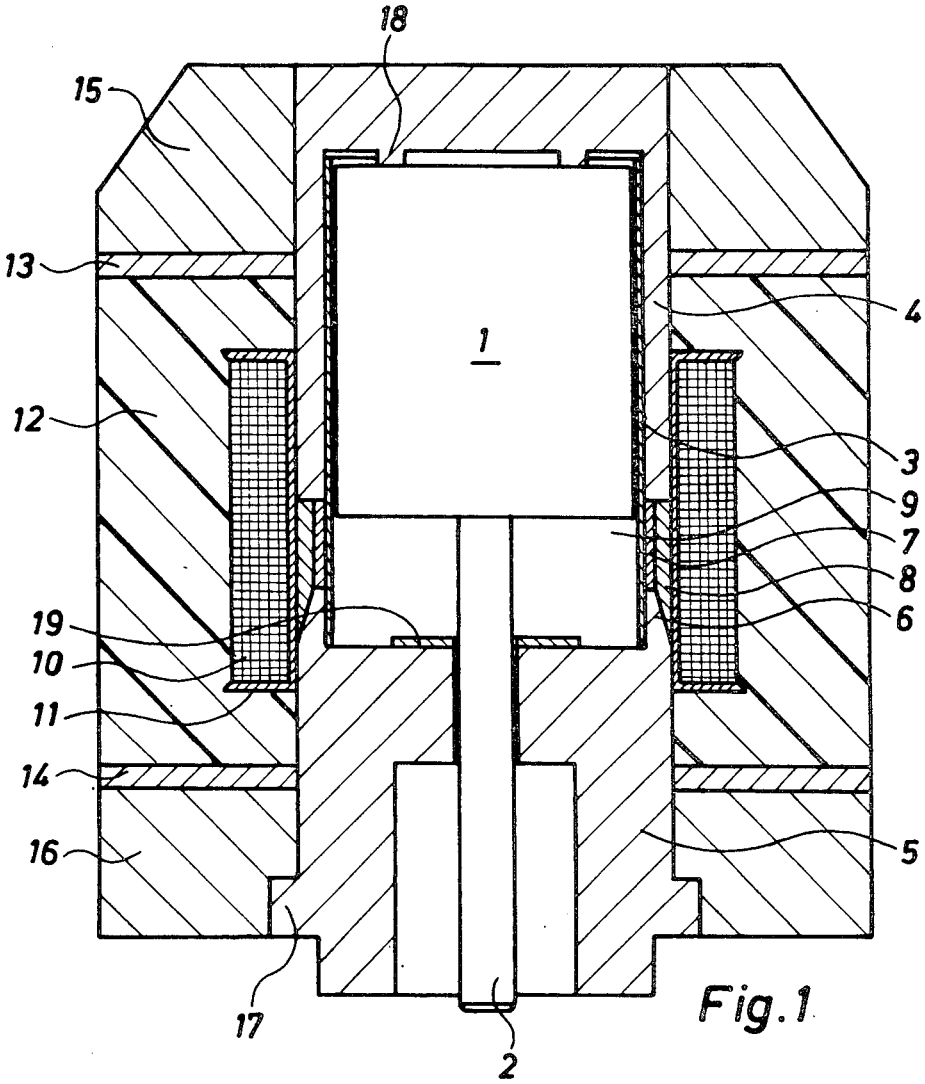
FIG. 1 is a longitudinal section through a first exemplary embodiment.

Referring to the drawing, armature 1 of an activating magnet has an activating ram 2, which can act on a slide (not shown) of an hydraulic or pneumatic valve. The armature 1 is surrounded by a guide tube 3 made of a nonmagnetizable material, such as stainless steel, which can be manufactured with low tolerances to provide adequate clearance without incurring a large expense. A pole tube portion 4 surrounds the guide tube 3 and the side of the armature 1 opposite the activating ram 2. A spacing ring 7 which also consists of a nonmagnetizable material is disposed between the bottom of pole tube portion 4 and the top of pole tube portion 6, as best seen in FIG. 1. Pole tube portion 6 is formed in one piece with a pole core 5 through which the activating ram 2 passes, with play.

Spacing ring 7 is surrounded by a connecting ring 8 made of brass solder and can also be economically manufactured with close tolerances. The pole tube portions 4 and 6 and the spacing ring 7 all have the same inside diameter and are placed tightly on the guide tube 3 which extends over the entire length of the armature chamber 9, which is longer than the armature 1 by the length of the stroke made by said armature 1.

The magnet housing, which consists of the pole tube portions 4 and 6, the rings 7 and 8 and the pole core 5, needs to be machined only on its outside surface after the connection ring 8 is made by soldering or the like. Spool 11 surrounds and supports coil windings 10. Spool 11, in turn, is surrounded by a spool housing 12 made of a suitable cast resin. Intermediate rings 13 and 14 are provided on both sides of the spool housing 12, which are joined at the ends by end rings 15 and 16 held against the magnet housing by an outwardly projecting collar in the area of the pole core 5. A stop ring 18 projects from the frontal side of the floor of the pole tube portion 4 and a stop ring 19 is arranged on the opposite side in the armature chamber. The floor of the pole tube portion 4 can be penetrated to receive a manually activated servicing ram which can then be suitably sealed to the outside. The armature 1 and the pole tube portions 4 and 5 are each made of a magnetizable material.

Figure 2:
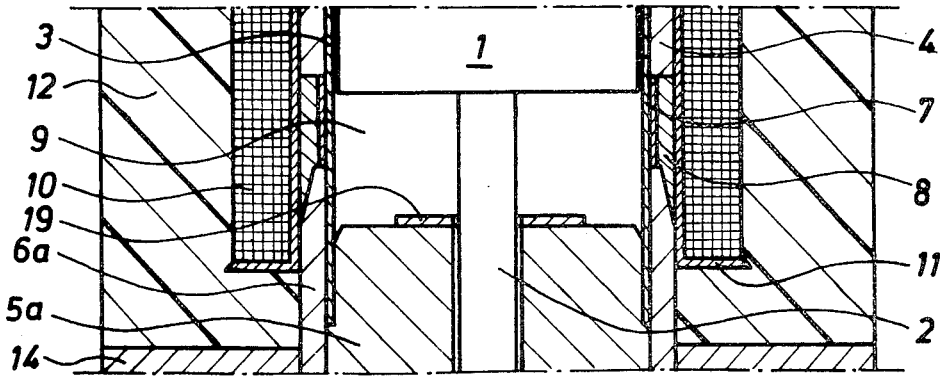
FIG. 2 is a partial longitudinal section through a second exemplary embodiment.

The exemplary embodiment according to FIG. 1 has an inaccessible, pressure-proof armature chamber, while the exemplary embodiment according to FIG. 2 described below has an accessible, pressure-proof armature chamber. For this purpose the pole core 5*a* (FIG. 2) and the pole tube 6*a* are separated and formed so as to be separable from each other. The pole core 5*a* is arranged within the pole tube portion 6*a*, which extends up to an outwardly projecting collar of the pole core 5*a* on the side facing the activating ram 2 and which itself includes a collar corresponding to the collar 17. The other elements are the same as in the previous exemplary embodiment and are therefore provided with the same reference numerals. The guide tube 3 surrounds the portion of the pole core 5*a* which faces the armature 2 and is appropriately set back.

In the above described exemplary embodiments the spacing ring 7 is arranged on the inside and the connecting ring 8 is arranged on the outside. These rings can also be arranged in the reverse order shown herein.

Although only a preferred embodiment is specifically illustrated and described herein, it will be appreciated that many modifications and variations of the present invention are possible in light of the above teachings and within the purview of the appended claims without departing from the spirit and intended scope of the invention.

I claim:

1. Activating magnet comprising two coaxial pole tube portions which are spaced from each other and have the same inner and outer diameters, said pole tube portions are connected with each other by a connecting ring containing solder, a spacing ring made of a nonmagnetizable material and surrounded by the connecting ring is arranged between the two pole tube portions, said spacing ring is thinner than the two pole tube portions, whereby the connecting ring has the same outer diameter and the spacing ring has the same inside diameter as the pole tube portions, or vice versa.

2. Activating magnet according to claim 1, including a guide tube provided on the inner periphery of the pole tube portions and the spacing ring, said guide tube being made of a nonmagnetizable material.

* * * * *